United States Patent [19]

Pettit

[11] 4,014,051

[45] Mar. 29, 1977

[54] BACK SCRATCHING AND/OR SCRUBBING DEVICE

[76] Inventor: Lewis A. Pettit, 915 S. Second St., Millville, N.J. 08332

[22] Filed: Sept. 4, 1975

[21] Appl. No.: 610,180

[52] U.S. Cl. ..... 4/158; 15/110

[51] Int. Cl.[2] ..... A47K 3/22; A47L 13/12; A47L 13/50; E04F 21/16

[58] Field of Search ..... 4/158, 184; 15/146, 15/160, 110, 244 A, 244 B, 244 C

[56] References Cited

UNITED STATES PATENTS

| | | | |
|---|---|---|---|
| 3,040,337 | 6/1962 | Fjelstad | 15/160 UX |
| 3,478,369 | 11/1969 | Ensley | 4/158 |
| 3,631,560 | 1/1972 | Atkins | 4/158 |
| 3,750,226 | 8/1973 | Morgan | 4/158 |

OTHER PUBLICATIONS

Advertisement in Plastics, Jan. 1965, vol. 30, No. 327, p. 68.

*Primary Examiner*—Steven L. Stephan

[57] ABSTRACT

A single device provides means for either scratching or scrubbing the back of a user as desired, which comprises a pair of similar operating elements having front and back surfaces, wherein the front surfaces carry the back-contacting instrumentalities and the rear surfaces are provided with rearwardly-extending supporting members having suction cups on their outer ends. The operating elements are in substantial edgewise alignment and are connected by means which permit relative pivotal movement about a vertical axis. The result enables the user to back against the device and so move with respect thereto in such a manner as to obtain the desired scratching or scrubbing effect.

4 Claims, 5 Drawing Figures

BACK SCRATCHING AND/OR SCRUBBING DEVICE

The present invention relates to devices which may be used to scratch or scrub the human back, and particularly to those which are adapted to be supported by a convenient wall surface, such as the wall of a shower stall, a wall surface which is adjacent a bath tub; or even a door if only scratching is desired.

It is, of course, very well known that many people enjoy having their backs scratched; and just as well known that it is difficult for a person to obtain satisfactory self-administered scratching of the back adjacent and somewhat below the shoulder blades; and especially when using only the fingers.

So far as presently known, all of the devices of the prior art which are adapted for such purposes are characterized by one or more deficiencies among which are inefficiency in operation, objectionable expensiveness, lack of durability, etc.

Objects of the present invention include the provision of a unit for the self-administered back-scratching or back-scrubbing, which is not only highly efficient in operation, but inexpensive to manufacture and durable in service.

Other objects and advantages will appear from the following description of a typical embodiment thereof and in the accompanying drawing, wherein like reference characters designate like parts, and wherein.

Figure 1:
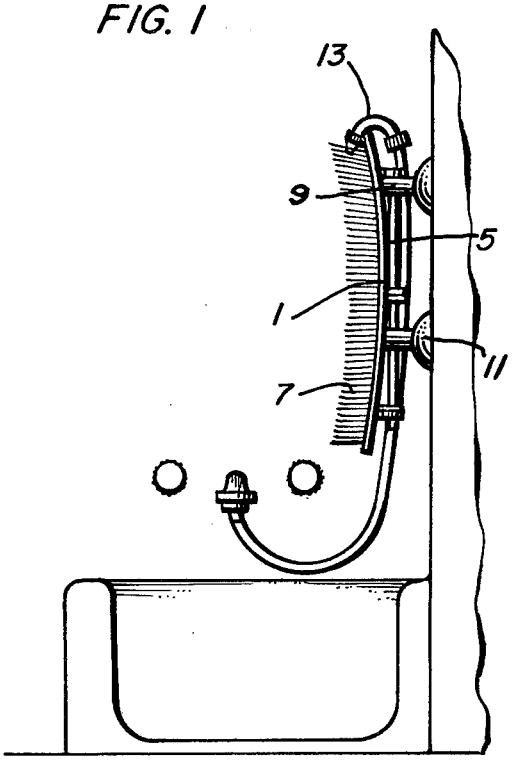
FIG. 1 is a side elevational view of a device which employs the teachings of the invention.
Figure 2:
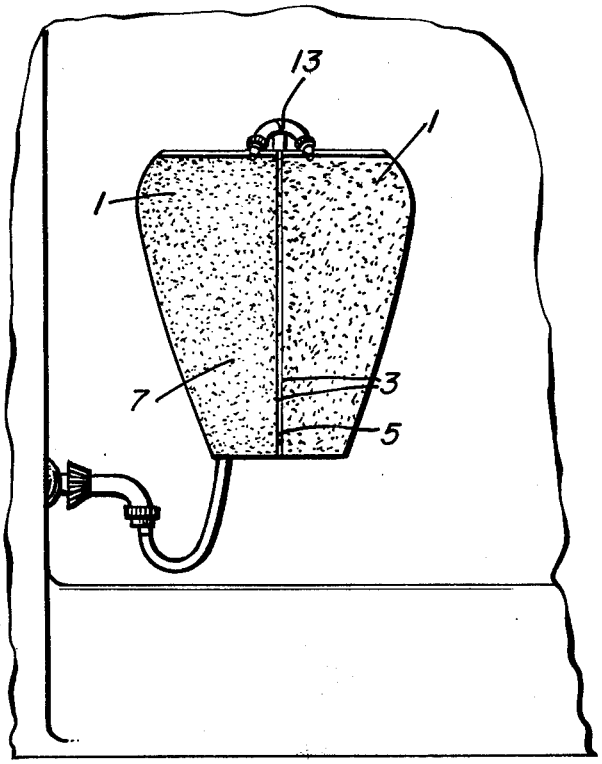
FIG. 2 is a front elevation of the showing of FIG. 1.

Referring more particularly to the drawing, the numeral 1 generally designates a pair of basic operating elements which are similar in size and shape and which are provided with closely adjacent but slightly spaced side edges 3 that are substantially straight and are connected by pivotal means 5 whereby they are relatively adjustable with respect to each other and with respect to the back of the user of the device when properly supported in a manner to be described hereinafter. The upper and lower edges of these basic operating elements are, as most clearly shown in FIGS. 2 and 3, substantially straight and in substantial parallelism.

Figure 3:
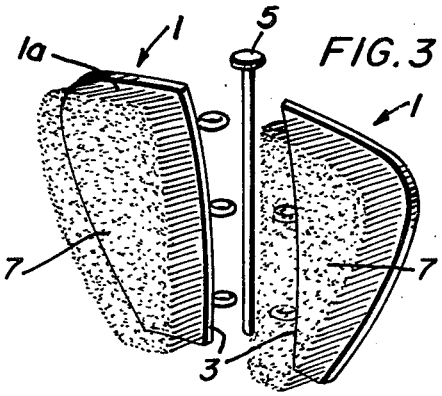
FIG. 3 is an exploded frontal view of the two basic operating elements of the device together with means for permitting the pivotal adjustment of one with respect to the other.

Referring to FIG. 3, the front surfaces 1a of the basic operating elements 1 are provided with attachable and replaceable means 7 for contacting the skin of the user which is suitable for the intended purpose, be it scratching on the one hand or scrubbing on the other; but which, as such, form no part of the present invention.

The front surfaces 1a of the basic operating elements 1 may be substantially flat as shown, or they may be either slightly concave or slightly convex; as desired.

Figure 4:
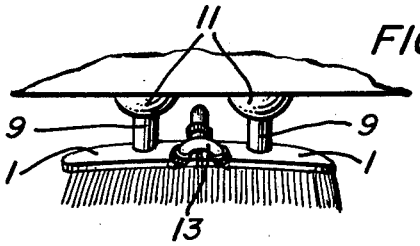
FIG. 4 is a plan or top view of the device.
Figure 5:
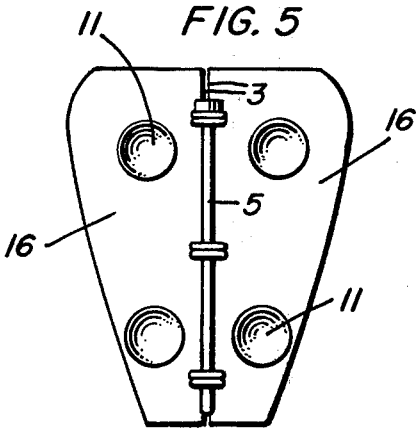
FIG. 5 is an elevational view illustrating the back of the two basic operating elements of the device, together with the means, including suction cups, for temporarily attaching the device to a wall surface.

Referring to FIG. 4, the back surfaces of the basic operating elements 1 are provided with a plurality of rearwardly extending supporting members 9, each of which carries a suction cup 11 at its outer end.

These supporting members 9 which are secured to the back surfaces of the basic operating elements may be adjustable, if desired, as by utilizing telescoping tubular members which are in screw-threaded engagement whereby the total lengths thereof may be extended or shortened.

According to the foregoing construction and arrangement, the skin-contacting means 7 on the front surfaces of the basic operating elements 1 may be adjusted forwardly and rearwardly pursuant to the desire of the user of the device.

With the suction cups 11 attached to a convenient wall surface or door, and at a suitable elevation thereon, the basic operating elements 1 will be very sturdily supported and enable the user to apply his or her back thereto with whatever pressure is desired, whereupon the replaceable skin-contacting means 7 performs in the manner indicated.

As shown in FIGS. 1, 3, 4 and 5 suitable water-supply means 13 may be mounted adjacent the upper ends of the basic operating elements 1 for assisting in a scrubbing when the latter are disposed in elevated position with respect to the bottom of a bath tub, shower stall, etc.

In the case of a shower stall, however, the water-supply means 13 may be eliminated as superfluous.

I claim:

1. A device for scratching and scrubbing the human back which is adapted for attachment to a wall surface comprising, in combination, a pair of substantially flat operating elements providing front and rear surfaces; and having adjacent edges of said operating elements being in substantial edgewise alignment, means converting said operating elements for relative pivotal movement about a vertical axis; the remote edges of said operating elements being downwardly tapered when viewed in elevation; a plurality of supporting members connected to the backs of said operating elements and extending rearwardly with respect thereto; a rearwardly-facing suction cup connected to the outer end of each of said supporting members; and means carried on the front surface of each of said operating elements for contacting the skin on the back of the user of the device.

2. A device for scratching and scrubbing the human back which is adapted for attachment to a wall surface comprising, in combination, a pair of substantially flat operating elements providing front and rear surfaces; and having adjacent edges of said operating elements being in substantial edgewise alignment, for relative means connecting said operating elements pivotal movement about a vertical axis; the remote edges of said operating elements being downwardly tapered when viewed in elevation; the upper and lower edges of said operating elements being substantially straight and in substantial parallelism; a plurality of supporting members connected to the backs of said operating elements and extending rearwardly with respect thereto; a rearwardly-facing suction cup connected to the outer end of each of said supporting members; and means carried on the front surface of each of said operating elements for contacting the skin on the back of the user of the device.

3. A device for scratching and scrubbing the human back which is adapted for attachment to a wall surface comprising, in combination, a pair of substantially flat operating elements providing front and rear surfaces; means for connecting said operating elements for relative pivotal movement about a vertical axis, the adjacent edges of said operating elements being in substantial edgewise alignment means mounting said operating elements for relative pivotal movement about said vertical axis; the remote edges of said operating elements being downwardly tapered when viewed in elevation; said mounting means including a plurality of supporting members connected to the backs of said operating elements and extending rearwardly with respect thereto; a rearwardly-facing suction cup connected to the outer end of each of said supporting members; means carried on the front surface of each of said operating elements for contacting the skin on the back of the user of the device; and water supplying means carried on the upper ends of said substantially flat operating elements.

4. A device for scratching and scrubbing the human back which is adapted for attachment to a wall surface comprising, in combination, a pair of substantially flat operating elements providing front and rear surfaces; means for connecting said operating elements for relative pivotal movement about a vertical axis, the adjacent edges of said operating elements being in substantial edgewise alignment, means mounting said operating elements for relative pivotal movement about said vertical axis; the remote edges of said operating elements being downwardly tapered when viewed in elevation; the upper and lower edges of said operating elements being substantially straight and in parallelism; said mounting means including a plurality of supporting members connected to the backs of said operating elements and extending rearwardly with respect thereto; a rearwardly-facing suction cup connected to the outer end of each of said supporting members; means carried on the front surface of each of said operating elements for contacting the skin on the back of the user of the device; and water supplying means carried on the upper ends of said substantially flat operating elements.

* * * * *